United States Patent [19]

Carlson et al.

[11] Patent Number: 4,479,376

[45] Date of Patent: Oct. 30, 1984

[54] VERTICAL FOURSLIDE METAL FORMING MACHINE

[75] Inventors: Robert E. Carlson, South Venice, Fla.; Halsey W. Skilton, Torrington, Conn.

[73] Assignee: The A. H. Nilson Machine Co., Inc., Shelton, Conn.

[21] Appl. No.: 353,189

[22] Filed: Mar. 1, 1982

[51] Int. Cl.[3] ..... B21D 37/12

[52] U.S. Cl. ..... 72/455; 474/114

[58] Field of Search ..... 72/137, 402, 403, 441, 72/442, 444, 452, 455; 140/105; 74/16; 474/114, 113, 132; 200/298

[56] References Cited

U.S. PATENT DOCUMENTS

| | | | |
|---|---|---|---|
| 2,400,448 | 5/1946 | Wellstein | 474/114 |
| 2,832,849 | 4/1958 | Walter | 200/298 |
| 3,675,460 | 7/1972 | Cavagnero et al. | 72/402 |

*Primary Examiner*—Lowell A. Larson
*Assistant Examiner*—Linda McLaughlin
*Attorney, Agent, or Firm*—Mattern, Ware, Stoltz & Fressola

[57] ABSTRACT

A fourslide metal wire and strip forming machine is provided with a removable drive motor mounted on a hinged door; a clutch shaft journalled in a plurality of bearings permitting easy removal and replacement of electric clutch and brake assemblies; a dual-speed drive shaft driven by a shiftable gear train, turning a reversible feed cam providing single and double feed cycles; a positive-action feed mechanism with resilient shock-mounting actuation for the feed carriage gliding on a low-friction ball-and-groove bushing; at least one tool-carrying angle slide cooperating with the conventional four slides converging upon the mandrel; an adjustable kingpost removable from behind the preferably vertical fourslide plane; and a supplemental "electronic hand-wheel" drive motor connected for reversible incremental actuation in small increments to facilitate tooling and feed assembly set-up operations. The vertical fourslide machine moves wire or strip stock through its feed mechanism and press area to its kingpost and mandrel in a right-to-left direction as viewed by the operator in front of the machine, and tooling for forming slides and press units is interchangeable with that of conventional "horizontal" fourslide machines.

5 Claims, 15 Drawing Figures

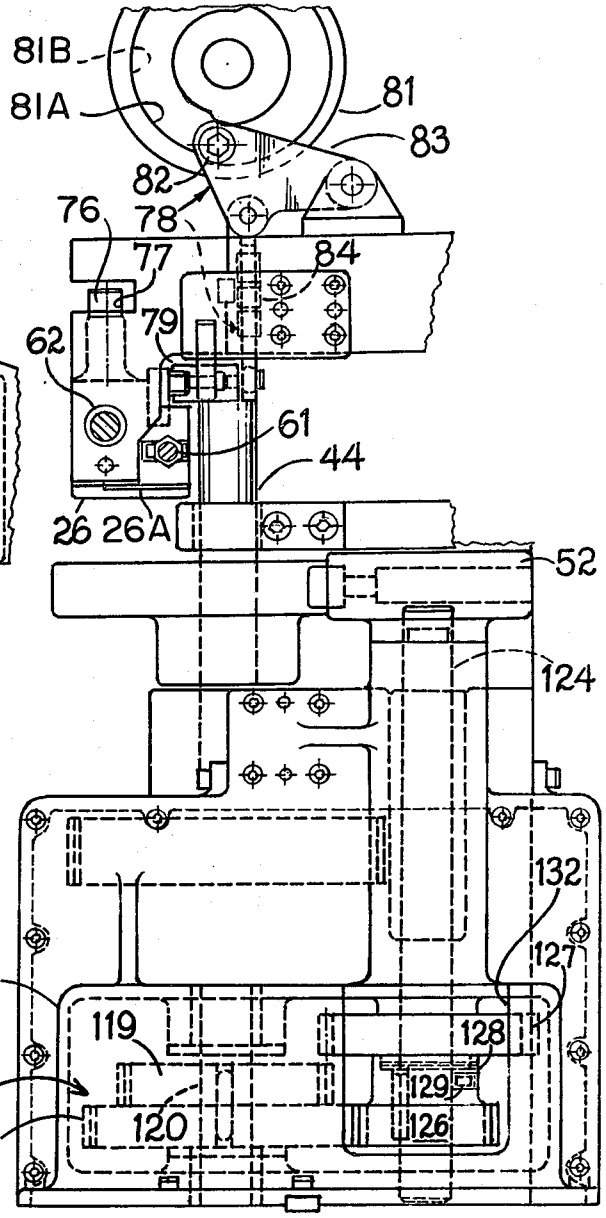
Fig. 5
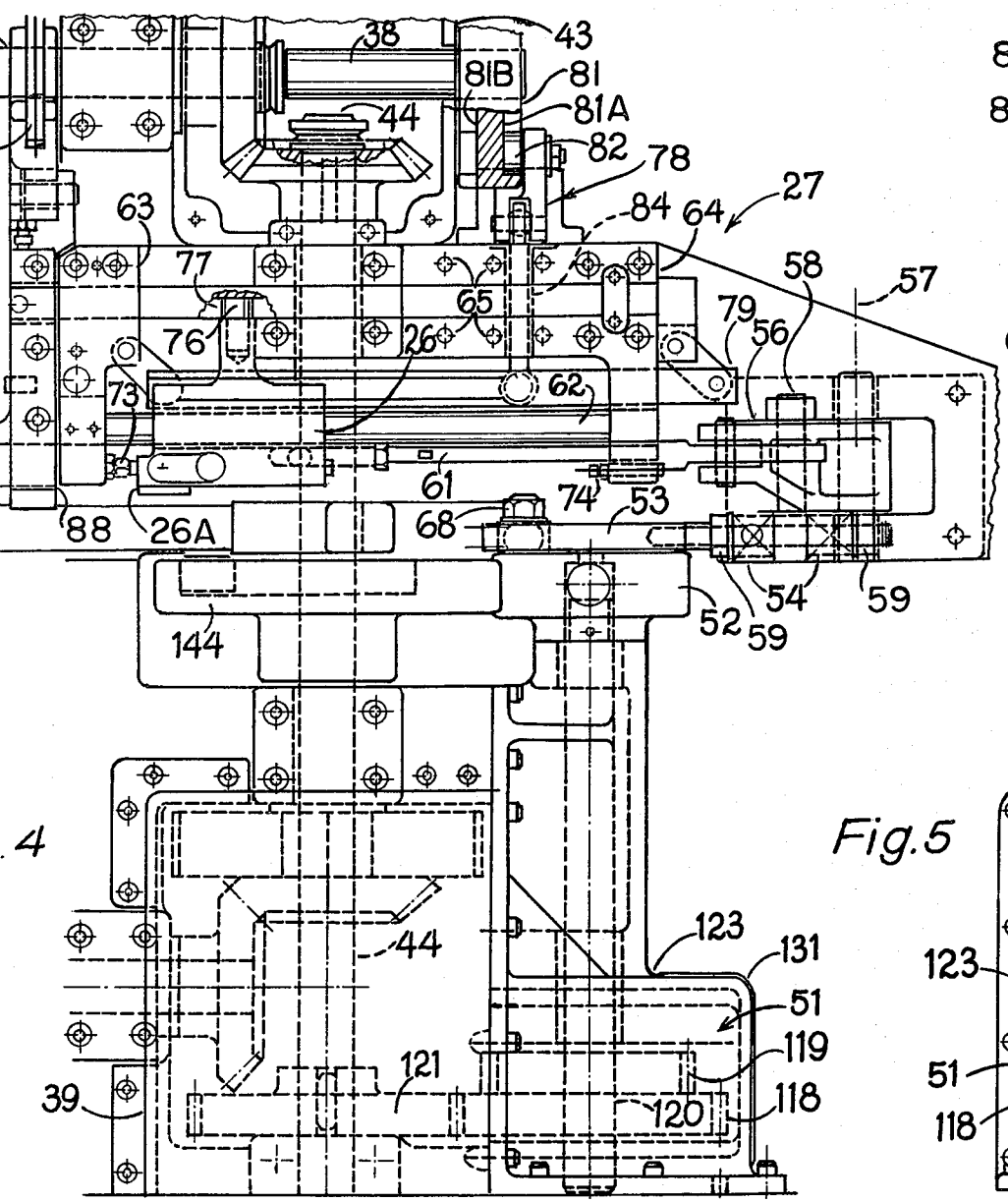
Fig. 4
Fig. 4A

Fig. 8-A

VERTICAL FOURSLIDE METAL FORMING MACHINE

The invention relates to "fourslide" metal forming machines and particularly to such machines having their slide actuating cam shafts arranged in a rectangular pattern defining a vertical plane, providing ease of access to tooling and die sets and all other working parts both from the front of the machine and from the rear.

Conventional "horizontal" fourslide forming machines have their press units and slides actuated by cams mounted on camshafts drivingly connected by bevel gears and forming a rectangular pattern defining a horizontal rectangle. Examples of such "horizontal" fourslide machines are those manufactured by the A. H. Nilson Machine Company of Shelton, Conn. and identified as the Nilson "S", "F" and "T" Series as well as the Nilson "700" Series fourslide machines.

While these horizontal fourslide machines are highly effective and fulfill many important demands in the metal forming industry, they afford somewhat limited access to the tooling and the press units for adjusting, removing, replacing, checking and maintaining tooling. In particular, access from below their horizontal plane to all of the working slides, cams and tools is often limited, and the mandrel- and stripper-supporting kingpost in the fourslide tooling area is installed beneath all other tooling, making it inaccessible without disturbing the overlying forming tools if any kingpost maintenance or adjustment is required.

Conventional fourslide machines often provide minimum accessibility for drive motors, clutches and brakes, and it may be necessary to remove the motor and the drive shaft entirely in order to service or replace either the clutch or the brake in such conventional fourslide machines.

Alternative choices of feed cam actuation over 90° or 180° sectors of cam rotation have been offered in conventional fourslide machines, but these choices often require disassembly and replacement of feed cams and feed gear trains, with the risk that replaced parts may be stored in other parts of the plant and can be lost or mislaid.

The introduction of electronic control systems and digital readouts has led to the use of convenient push-button control panels displayed to the operator at a front corner or a rear corner of the horizontal rectangle formed by the fourslide cam shafts in these conventional "horizontal" fourslide machines. Such control panels often require the machine setup operator to move back and forth many times, from remote portions of the fourslide machine to the control panel and back.

The "vertical" fourslide metal forming machines of the present invention, being introduced by the A. H. Nilson Machine Company as its "1100 Series", offer unique advantages which minimize or eliminate many of the foregoing disadvantages of conventional fourslide machines.

Accordingly, it is a principal object of the present invention to provide a vertical fourslide machine affording easy access to the feed area, the press unit area and the fourslide metal forming area of the machine, with excellent visibility, high production speeds and ease of maintenance.

Another object of the present invention is to provide such vertical fourslide machines with a novel drive system having an easily disengageable drive motor and belt drive arrangement.

A further object of the present invention is to provide such vertical fourslide machines with a vertically mounted belt-driven drive shaft, with several easily removable bearing blocks, permitting disengagement and removal of clutch and brake mechanisms for maintenance or replacement without the need for removing the drive shaft from the machine.

Still another object of the invention is to provide such vertical fourslide metal forming machines with an easily accessible kingpost assembly having multiple supports in the machine frame, and which may be removed from the rear without disturbing any of the fourslide tooling.

A further object of the invention is to provide such vertical fourslide machines with a feed mechanism offering the choice of 90° or 180° feed cam sector actuation, utilizing a movable cam and a shiftable gear train with components which are not normally removed from the machine but merely installed in different positions to provide the desired different feed cam sector actuation.

Another object of the invention is to provide such fourslide machines with improved feed mechanisms incorporating a separate feed check for maximum reliability, shock absorbing dual-spring mountings on the eccentric feed drive linkage and anti-friction linear ball bearing mounting of the feed carriage on a single hardened shaft, with a highly reliable toggle action locking mechanism actuated by the feed cam, and with an adjustable feed stop block supporting the end of the hardened shaft at shorter spans for shorter feed lengths, to reduce the unsupported length of the feed shaft.

Still another object of the invention is to provide such vertical fourslide machines with a manual handwheel for closely controlled small angular sector adjustment of the camshafts during setup, checking and maintenance.

A still further object of the invention is to provide such vertical fourslide machines with an electronic handwheel camshaft advance drive system.

Another object of the invention is to provide such vertical fourslide metal forming machines incorporating a movable control pendant displayed to the operator near eye level, outside the preferred infrared light beam guard systems or other safety zones, and which may be moved by the setup operator from the forming area past the press area to the feed area of the machine for easy accessibility to the control panel from all of these locations.

A further object of the invention is to provide such vertical metal forming fourslide machines affording interchangeability of forming slide tooling and press unit tooling with that used on horizontal fourslide machines such as the 1F machine manufactured by the A. H. Nilson Machine Company.

Other objects of the invention will in part be obvious and will in part appear hereinafter.

The invention accordingly comprises the features of construction, combinations of elements, and arrangement of parts which will be exemplified in the construction hereinafter set forth, and the scope of the invention will be indicated in the claims.

For a fuller understanding of the nature and objects of the invention, reference should be had to the following detailed description taken in connection with the accompanying drawings.

BRIEF DESCRIPTION OF THE DRAWINGS

FIG. 4 is a fragmentary front elevation view of the feed mechanism of the fourslide machine;

FIG. 4A is a fragmentary left end elevation view of the feed mechanism showing the separate feed check unit;

FIG. 5 is a fragmentary right end elevation view of the feed assembly and feed drive components of the fourslide machine shown in FIG. 4;

FIG. 8A is a schematic top plan view of this same drive train;

THE BEST MODE FOR CARRYING OUT THE INVENTION

Figure 1:
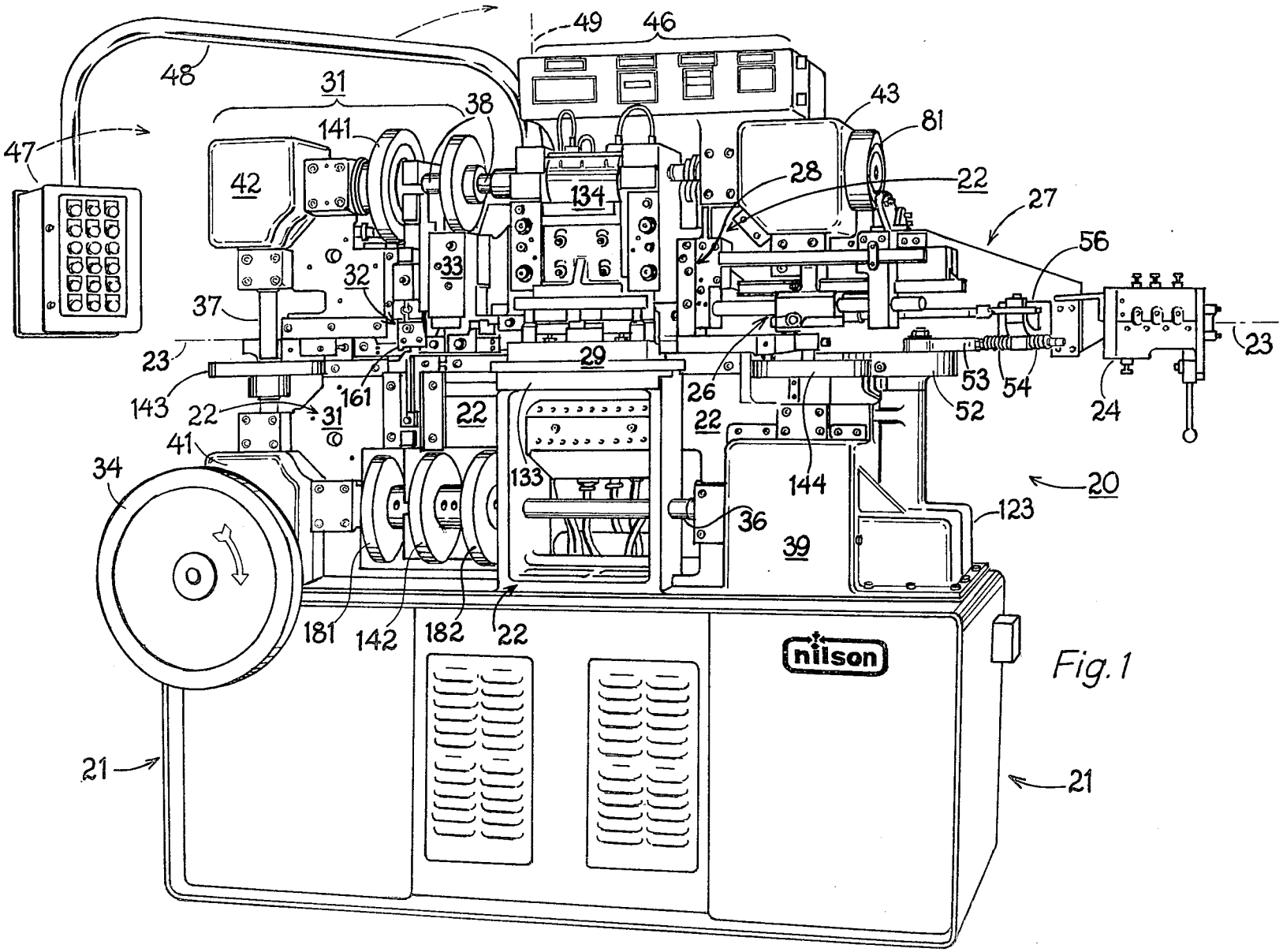
FIG. 1 is a front perspective view of a vertical fourslide machine of the present invention.

The vertical fourslide metal forming machine 20 shown in the perspective view of FIG. 1 is the Nilson Model 1100 vertical metal forming machine being introduced by the A. H. Nilson Machine Company of Shelton, Conn. Mounted on a base housing 21 is a supporting machine frame generally indicated at 22 on which all of the fixed and moving parts of the overall assembly are sturdily mounted. Wire or strip stock enters the fourslide machine along a feed path 23—23 from the right-hand end of the machine, with the stock first entering a stock straightener 24.

PRINCIPAL SUBASSEMBLIES

Proceeding from right to left, the stock moves from straightener 24 through the gripping jaws of a feed carriage 26 comprising a major portion of a feed assembly 27, and then to a separate feed check unit 28. From this point, the advancing wire or strip stock passes through the central press area 29 of the fourslide machine, forming the principal central vertical portion of the machine illustrated in the perspective view of FIG. 1. The stock then moves to the left metal-forming portion 31, where the fourslides and two optional angle forming slides drive the forming tools to bend and shape the stock around a mandrel or center form supported on kingpost 161 protruding from the rear into kingpost forming area, after the workpiece is severed by cutoff unit 33, just to the right of the kingpost 161.

The machine 20 is preferably adapted to utilize tooling which is interchangeable with that of such horizontal fourslide machines as the A. H. Nilson Machine Company's 1F fourslide machine.

At the lower left corner of the metal-forming area 31 is handwheel 34, which may be engaged to advance the lower camshaft 36, the left camshaft 37, the upper camshaft 38 and the right camshaft 44 by small angular increments during setup and adjustment of the fourslide machine 20. All four camshafts 36, 37, 38 and 44 are rotatably mounted in suitable bearings and geared together by bevel gears enclosed in four corner gear boxes, a right lower gear box 39, a left lower gear box 41, a left upper gear box 42 and a right upper gear box 43. The lower camshaft 36 and the upper camshaft 38, with their right-hand ends geared together by suitable bevel gears joining them to the right camshaft 44 joining the two right gear boxes 39 and 43, are best seen in FIG. 4.

A rear control panel mounted on the rear of the machine at convenient working height is surmounted by digital readout units 46, displaying camshaft rotation from 0° to 360° for cam adjustment, and also showing camshaft rotational velocity in RPM. A predetermined count unit which may be set to shut down the machine after completion of any predetermined number of workpieces is also incorporated in the digital readout units 46.

A movable pendant control panel 47 is shown at the upper left-hand portion of FIG. 1 suspended at the end of an overhead arm 48. Arm 48 is pivoted about a vertical axis 49 at the rear of the machine 20, allowing pendant 47 at the end of arm 48 to be moved from its left position, shown in FIG. 1, through a range of positions suspended in front of the vertical fourslide machine 20, to a rightmost position where pendant control panel 47 is suspended in front of stock check 28 and feed assembly 27. The pendant control panel presents electronic remote drive speed control buttons, and also provides a pushbutton control station for an optional electronic variable speed reversible drive control, thus replacing handwheel 34 by an "electronic handwheel" system.

During setup, pendant 47 may be moved by the operator from end to end in front of the machine 20, pivoting about axis 49. After setup is complete, the pendant 47 may be moved to the left toward the position shown in FIG. 1 where it may be left during normal operation of the machine.

FEED SUBASSEMBLY

Figure 2:
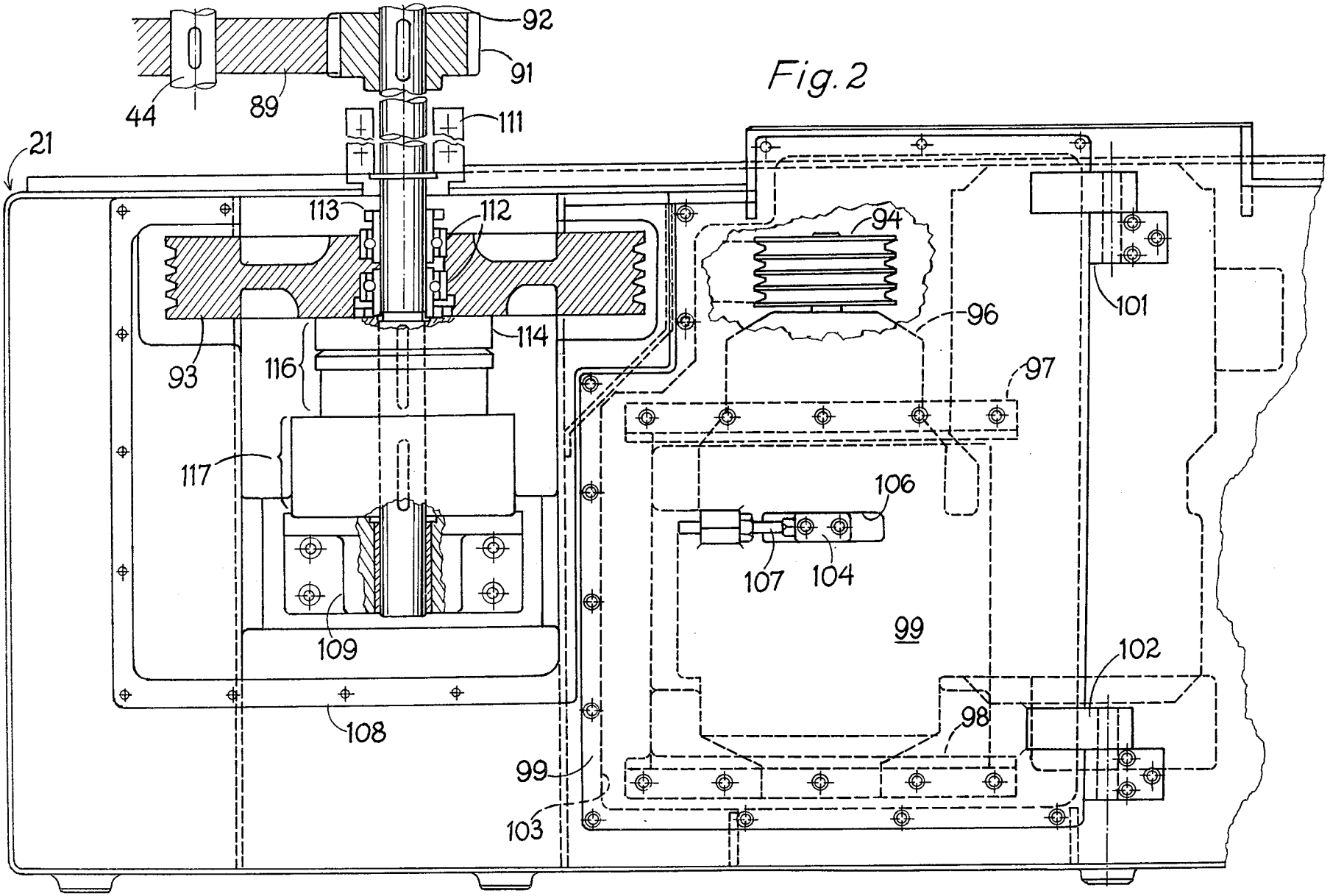
FIG. 2 is a fragmentary enlarged rear elevation view of the same vertical fourslide machine showing its lower housing drive motor, belt drive and vertical drive shaft.

All subassemblies of the machine are powered by a single drive motor which turns the right camshaft 44 shown in FIGS. 2 and 4. Feed assembly 27 is driven through a feed drive gear train 51 which turns an eccentric 52 having an adjustable connecting rod 53 which connects it through a pair of shock mounting springs 54 to a reciprocating pivoted feed arm 56 which reciprocates the feed carriage 26.

Feed arm 56 is shown in foreshortened view in FIG. 4, with its rear end pivoted about a vertical pivoting axis 57 positioned toward the rear of the machine 20. A connecting rod 53 is joined to feed arm 56 by a pivot pin 58, preferably sandwiched between two helical compression coil springs 54, which are themselves sandwiched between two nuts 59 threadedly engaged on the threaded end of the connecting rod 53.

The forward end of feed arm 56 and feed carriage 26 are both connected by pivot pins to a feed link 61, which transmits the right and left reciprocating motion of the forward end of the feed arm 56 to produce right and left reciprocating motion of feed carriage 26.

Feed carriage 26 is slidingly mounted for right/left reciprocating motion on antifriction linear bearings connecting carriage 26 to a hardened horizontal shaft 62. For example, a TEK Thomson Series "BG" ball groove shaft/super ball bushing assembly provides highly effective low friction reciprocating motion of feed carriage 26, while minimizing the component cost of this low friction bearing.

Feed shaft 62 has its ends solidly anchored in two stock blocks suspended from the frame of the machine, a left-hand stock block 63 bolted in fixed position near the stock check unit 28, and a right-hand stock block 64 bolted to the machine frame at one of a variety of positions which bring it progressively closer to left-hand stock block 63. For example, the plurality of bolt holes 65 provide a series of four different positions for right-hand stock block 64 which are successively closer to left-hand stock block 63, thus minimizing the unsupported span of feed shaft 62 between the two stock blocks, assuring its sturdy rigidity for guiding the feed carriage 26 in its reciprocating motion.

Figure 6:
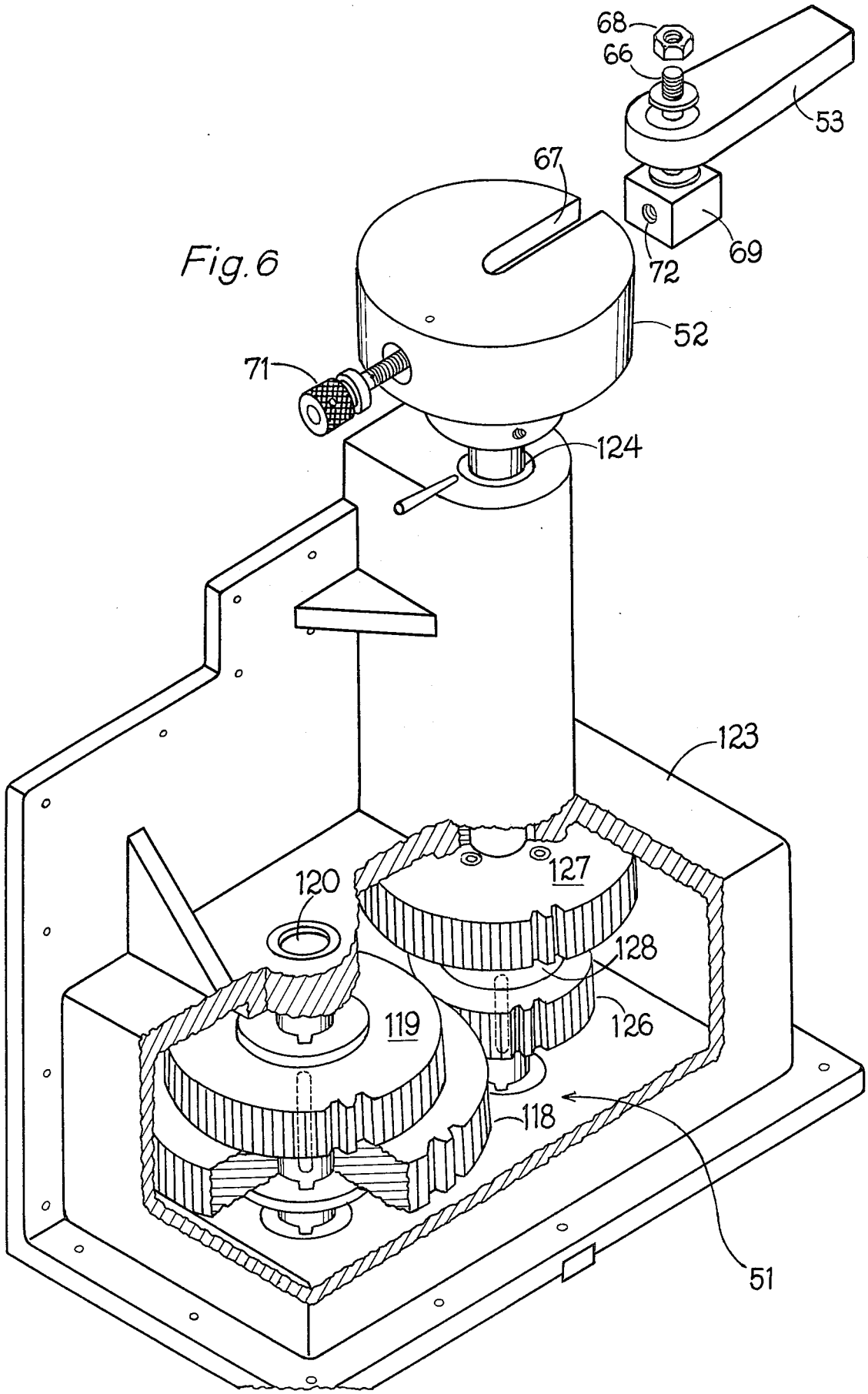
FIG. 6 is a fragmentary enlarged perspective view of the feed drive eccentric and its feed drive gear train, which may be shifted for alternate optional feed cam sector actuation.

The stroke of that reciprocating motion is governed by the eccentricity of a pivot bolt 66 joining connecting rod 53 and eccentric 52. As indicated in FIG. 6, this pivot bolt 66 is slidedly movable in a radial slot 67 in eccentric 52, and may be tightened in any position by torquing its nut 68, drawing its lower anchor block 69 upward against the underside of eccentric 52. A thumbscrew adjustment nut 71 extends through the body of eccentric 52 at a point opposite the radial slot 67, and has its threaded shaft engaged in a threaded bore 72 in anchor block 69 to facilitate fine adjustment of pivot bolt 66 along radial slot 67 for selection of the desired feed stroke of feed carriage 26.

Sturdy adjustable feed stops facing the respective ends of feed carriage 26 are provided on the stock blocks 63 and 64, with threaded studs 73 and 74 adjustably protruding from threaded holes in these respective stock blocks 63 and 64.

The feed carriage 26 is illustrated at the left end of its feed stroke in FIG. 4, abutting the left threaded stud feed stop 73. Protruding upward from the top of the feed carriage 26 on a vertical rotational axis is a guide roller 76 rolling in a downwardly concave overlying groove track 77 serving to maintain the feed carriage 26 in vertical alignment throughout its reciprocating travel.

Mounted on the rear side of feed carriage 26 is the actuating mechanism shown generally at 78 conveying the reciprocating vertical movement of a parallelogram linkage mounted feed actuator bar 79 to stock clamping jaws incorporated in feed carriage 26. Bar 79 is moved vertically by the cam follower mechanism shown in the upper portions of FIGS. 4 and 5, including feed cam 81 engaging a follower roller 82 mounted on a pivoting follower arm 83 serving as a bellcrank or lever converting radial movement of the follower roller 82 into vertical reciprocating movement of a connecting link 84, whose upper end is pivotally joined to the pivoted follower arm 83 and whose lower end is pivotally connected to the actuator bar 79. By this means, radial movement of follower roller 82 is converted to vertical translation of the horizontal actuating bar 79 serving to actuate the clamping jaws 26A operated in the feed carriage 26 at all positions along the reciprocating path of feed carriage movement.

As shown in FIG. 4 and FIG. 4A, a stock check unit 28 is mounted closely adjacent to the feed mechanism 27 in the downstream direction. This includes a stock check cam 85 vertically reciprocating a follower shaft 86 whose upper end pivotally supports a follower roller 87 engaging the periphery of stock check cam 85. Stock check clamping jaws 88 in the stock feed path form the lower end of follower shaft 86. Shaft 86 is mounted for sliding vertical reciprocation in suitable bearings formed in the machine frame and is positioned independently to the left downstream from feed carriage 26 and all associated parts of the feed mechanism subassembly 27.

The stock check unit cooperates with the feed mechanism 27 in a conventional manner. As feed block 26 completes its leftward feed stroke, its jaws 26A open and check clamping jaws 88 simultaneously close, holding the strip or wire stock in place for stamping and forming operations. During these operations, feed block 26 is returning toward the right end of its stroke, with jaws 26A remaining open. After stamping and forming operations are completed, check jaws 88 open and jaws 26A clamp the stock, which is then fed to the left as feed stock 26 again moves left through its feed stroke.

As shown at the top of FIG. 4, the upper camshaft 38 thus supports the stock check cam 85, the bevel drive gear engaging a corresponding bevel drive gear on the upper end of the right camshaft 44, and the feed cam 81.

BELT DRIVE SYSTEM

As shown in FIG. 2, the right camshaft 44 is provided with a keyed driven gear 89 engaging a drive pinion 91 which is keyed to a clutch shaft 92 vertically rotatable in a journal or bearing block protruding upward from base housing 21, to position pinion 91 in driving engagement with driven gear 89. The lower end of clutch shaft 92 extends downward inside base housing 21 to a lower journal bearing block elevated from the bottom of base housing 21. Mounted for free rotation about the axis of clutch shaft 92 is a large multi-groove driven flywheel sheave 93 connected by V-belts to a correspondingly multi-grooved drive sheave 94 mounted on the shaft of a drive motor 96. Drive motor 96 is a Reeves variable speed Model 200 three-horsepower drive unit providing a speed range from 420 to 4200 RPM.

Figure 3:
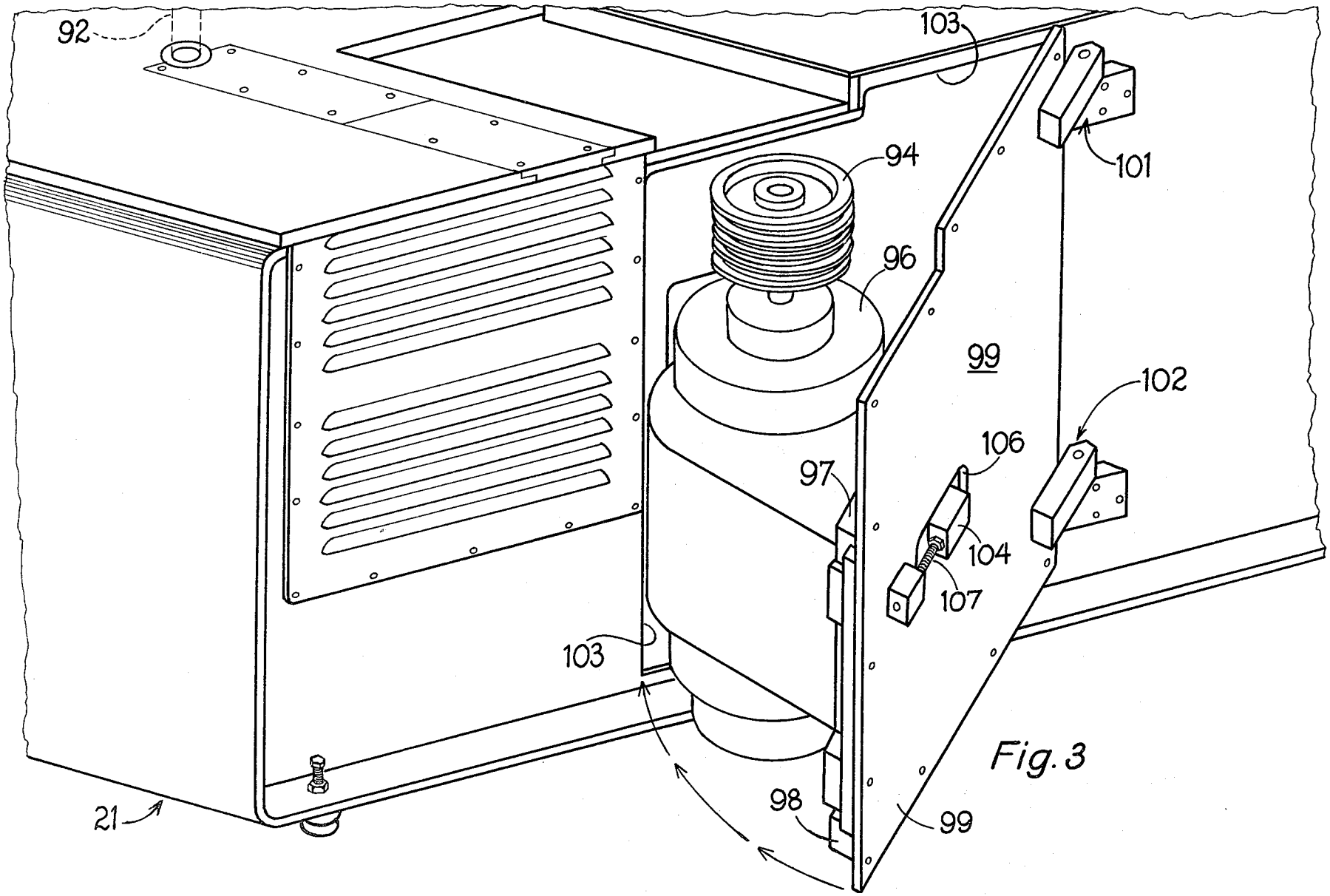
FIG. 3 is a fragmentary rear perspective view showing the hinged rear door drive motor support in its open position, for access to the motor.

As indicated in FIGS. 2 and 3, motor 96 is mounted for sliding horizontal reciprocating engagement in a pair of horizontal tracks 97 and 98 bolted to the inside surface of a motor access door 99 pivotally anchored for swinging movement on a pair of heavy hinge assemblies 101 and 102 bolted to the base housing 21 at the right-hand side of a motor door aperture 103.

By this means, as indicated in FIG. 3, the access door 99 when unbolted swings out freely on the sturdy hinges 101 and 102, carrying motor 96 entirely outside the housing 21 where the motor can easily be serviced or replaced if necessary with optimum speed and convenience. A belt tensioning slide 104 anchored to the motor 96 protrudes through a slot 106 in door 99 and is positioned by threaded tensioning bolt 107 threadedly engaged with a projection on door 99.

Adjustment of bolt 107 moves motor 96 horizontally along its tracks 97 and 98. Movement to the left relaxes belt tension in the V-belts joining sheave 94 to sheave 93, allowing the drive belts to be removed from sheave 94 through the partially open door 99, freeing motor 96 and door 99 for pivoting movement to the position shown in FIG. 3. When maintenance or motor replacement is completed, door 99 may be partially closed moving motor 96 inside housing 21, and the drive belts already engaged with driven flywheel sheave 93 may be reengaged with motor drive sheave 94, and then retensioned by adjustment of the belt tensioning slide 104 by turning tensioning bolt 107.

REMOVABLE CLUTCH AND BRAKE ASSEMBLIES

Mounted beside motor access door 99 on the rear of base housing 21 is a clutch shaft access door 108, through which the entire lower end of clutch shaft 92 and all components mounted thereon are easily accessible. Unbolting and removal of clutch shaft access door 108 discloses the components shown at the left-hand side of FIG. 2.

The vertical clutch shaft 92 extends from the upper portion of base housing 21 downward, and the lower end of shaft 92 is journaled in a lower bearing block 109 removably bolted to the base housing 21. A corresponding mid-bearing block 111 journals the mid-portion of clutch shaft 92 directly above base housing 21, and this mid-bearing block 111 is removably bolted to the machine frame 22. A top bearing block correspondingly journalling the upper end of clutch shaft 92 above pinion 91 is not shown in the drawing, but is similarly bolted removably to the machine frame 22.

Driven sheave 93 is mounted for free rotation about the axis of clutch shaft 92 on a plurality of sturdy ball bearings 112, whose inner races are anchored to clutch shaft 92 by removable clamping rings 113, and whose outer races are firmly seated within the central bore of the driven sheave 93.

Bolted to the underside of sheave 93 is the top collar 114 of an electric clutch unit 116, preferably Carlyle-Johnson Model 625A which is provided with a central hub keyed to clutch shaft 92, and engageable and disengageable with sheave 93 by operation of the clutch 116. Thus, when clutch 116 is disengaged, driven sheave 93 is free for freewheeling rotation about clutch shaft 92, and when clutch 116 is engaged, driven sheave 93 is locked through the clutch itself to provide driving torque to clutch shaft 92. In the preferred embodiment of the invention, the ball bearings on which driven sheave 93 is mounted on clutch shaft 92, are TEK Sealmaster bearings No. ER-28TC.

Directly beneath the clutch 116 is an electric brake unit 117, preferably Carlyle-Johnson Model 800FS, whose outer housing is bolted directly to lower bearing block 109 and whose inner hub is keyed to clutch shaft 92. During normal operation, clutch shaft 92 and its brake hub are free to rotate within the brake housing, but when electric brake 117 is applied, shaft 92 is normally stopped within two revolutions. Emergency stop time is approximately three-fourths of a revolution at 300 RPM. Both clutch and brake units are powered by electrical cables connected to the machine's control panels.

It will be noted in FIG. 2 that removal of the clutch shaft access door 108 exposes the drive sheave 93, clutch 116, brake 117 and lower bearing block 109. Since the clutch shaft 92 is supported in its upper bearing blocks, the lower bearing block 109 may be unbolted and removed, providing access for removal of brake 117 and thereafter clutch 116 without disturbing the drive sheave 93 or the upper end of clutch shaft 92. Thus, the electric clutch/brake is exposed for maintenance or replacement without removing driven flywheel sheave 93.

The motor start pushbutton on pendant control panel 47 automatically activates a digital camshaft RPM readout, one of the readout units 46, and the normal speed range for the camshafts is from 50 to 300 RPM.

CHOICE OF 90° OR 180° FEED GEARS AND CAM

As shown in FIGS. 1 and 4, upper camshaft 38 extends through a suitable aperture in the right-side wall of right upper gear box 43 and carries on its protruding end the double-faced reversible feed cam 81. One race 81A, cut in one of the faces of cam 81, guides feed cam follower 82 along a path moving it radially to close the clamping jaws gripping the stock in feed carriage 26 on a 180° cycle, twice during each camshaft revolution, and the cam race 81B cut into the opposite face of feed cam 81 engaged with follower 82 when cam 81 is mounted in reversed orientation closes these jaws in a 90° cycle, four times during each camshaft revolution. A corresponding gear shifting arrangement is shown in the lower portion of FIG. 5, and in FIG. 6. A high speed drive gear 118, surmounted by a low speed drive gear 119, are keyed together on a stud shaft 120 and rotated by engagement of the high speed drive gear 118 with a gear 121 keyed to the lower end of the right camshaft 44 inside the lower right gear box 39. As shown in FIG. 6, shaft 120 is journaled for rotation in an eccentric feed gear box 123 mounted just to the right of lower right bevel gear box 39 at the right end of the machine, directly above base housing 21.

In the rear portion of eccentric feed gear box 123 there is journaled a parallel shaft 124 on whose upper end the eccentric plate 52 is mounted. Keyed to the lower end of eccentric shaft 124 are two driven gears, a small high speed driven gear 126 shown engaged with high speed drive gear 118 in FIGS. 5 and 6, and upwardly spaced above it by more than the depth of one gear is a larger low speed driven gear 127, dimensioned for meshing engagement with low speed drive gear 119.

The spacing of the driven gears 126 and 127 is maintained by a collar 128 positioned between them and preferably formed integrally with the lower high speed drive gear 126. This collar 128 is provided with a set screw anchoring this assembly of gears 126 and 127 at one of two predetermined levels at the lower end of eccentric shaft 124. The set screw 129 in collar 128 is easily exposed to view by removing a cover 131, enclosing an access aperture 132 in the right end of eccentric feed gear box 123. The aperture 132 exposes both gears 126 and 127 and the set screw 129 in the collar 128 between them. Loosening of set screw 129 permits gears 126 and 127 with intermediate collar 128 to be lowered down eccentric shaft 124 until low speed driven gear 127 is engaged with low speed drive gear 119 and high speed driven gear 126 is lowered out of engagement with high speed drive gear 18. In this lowered position of the two gears, the eccentric is turned at a lower speed corresponding to the desired position of the 90°–180 ° reversible feed cam 81.

PRESS UNIT

The press unit 29 shown in the middle of FIG. 1 is mounted on frame 22, which is a rigid heavy duty casting for damping of low level sound vibraton. Press unit 29 incorporates the usual features of conventional fourslide press units, performing the normal functions of stamping die presses on the wire or strip stock incrementally advancing with each feed stroke through the fourslide machine. Horizontal leeway is provided for several inches of lateral adjustment of the press unit 29 along the press bed 133 of the machine and the correspondingly wide eccentric 134 mounted on upper camshaft 38 provides a larger bearing area and greater stability than conventional fourslide press units. If desired, a cam may be mounted on the open length of the lower camshaft 36 directly beneath the press unit 29 to drive a bottom auxiliary press slide, and space is provided for lateral adjustment or for two such press slides if desired. The press bed itself is adapted for approximately four inches of lateral adjustment from right to left. Within the press unit 29, a greater shut height than normally provided by conventional fourslide presses permits the use of standard length commercial punches and provides ample mounting depth and width. Interchangeability of tooling with press unit tooling designed for smaller fourslide press units is achieved by inserting an extra filler plate to adapt these smaller tooling sizes to the press unit 29. The vertical orientation of the press unit 29 places it at a comfortable working height above the floor for convenient set up, facilitating insertion of die sets.

FOURSLIDE FORMING AREA

In the same manner, the vertical orientation of the fourslides aligned for cooperation with the kingpost in the metal forming area 31 likewise facilitates changes and adjustments in fourslide tooling, exposing all four slides clearly to view and placing them within easy reach of the setup operator, as shown at the left side of FIG. 1.

Figure 7:
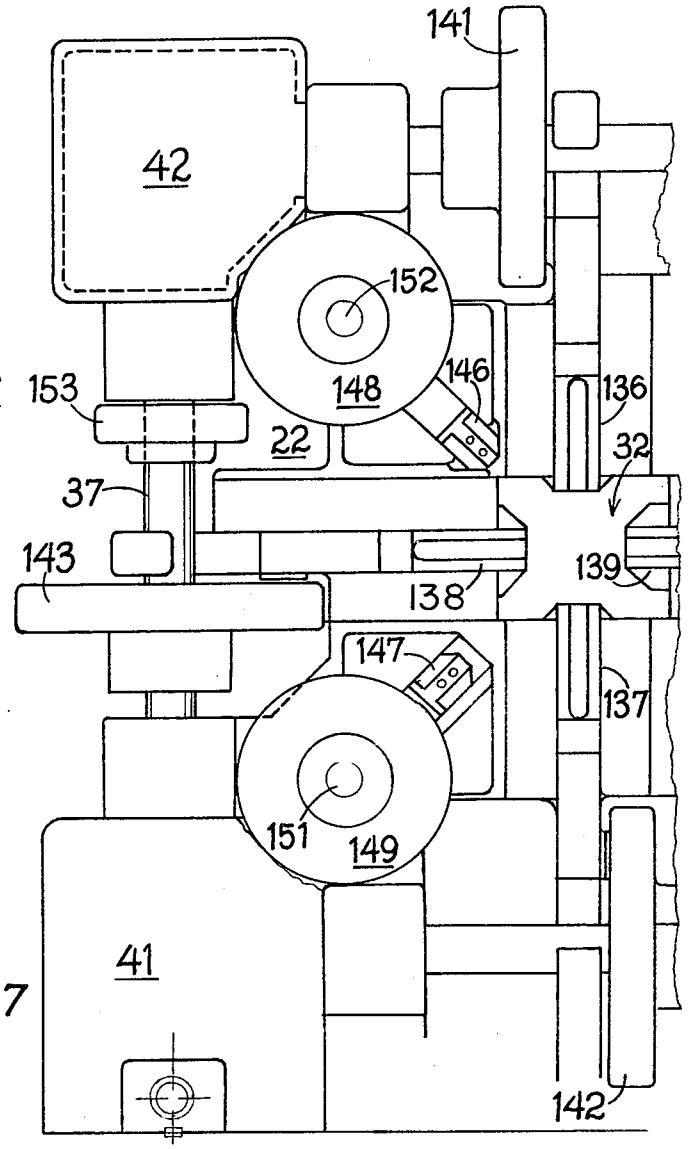
FIG. 7 is a fragmentary front elevation view of the fourslide forming area of the fourslide machine showing two optional angle forming slides forming a total of six working front slides in the forming area.

In the fourslide forming area 31 shown in FIG. 1 and the enlarged fragmentary view of FIG. 7, a top slide 136, a bottom slide 137, a left slide 138 and a right slide 139, all converging on the central kingpost area 32, are clearly illustrated in FIG. 7. The top slide 136 is actuated by a follower engaging the top slide cam 141 on the upper cam shaft 38. Bottom slide cam 142 on lower camshaft 36, left slide cam 143 on left camshaft 37 and right slide cam 144 on right camshaft 44 respectively actuate slides 137, 138 and 139 through suitable linkage. The right slide cam 144 is positioned at the far side of the press area 29, directly beneath the stroke of the feed carriage 26, as illustrated in FIGS. 1 and 4. Extended linkage passing below and behind press unit 29 connects cam 144 to the right slide 139. The operation of these cams, linkages and the fourslides cooperating with the kingpost is essentially conventional, and requires no elaboration.

A pair of optional angle forming slides, an upper angle slide 146 and a lower angle slide 147, provide additional forming functions and capabilities not available with conventional fourslide machines. As shown in FIG. 7, these two optional angle slides are preferably mounted at angles of approximately 45° between the left slide 148 and the two adjoining slides, the top slide 136 and the bottom slide 137. Mounting angles between about 40° and about 50° may be used, if desired. Cams actuating the angle slides 146 and 147 are mounted for rotation on horizontal shafts extending through the frame in the forming area 31 close to the diagonal center lines of the two slides 146 and 147. These respective cams 148 and 149 with their raceways on their rear sides facing the frame, cooperating with follower linkages covered by the flat outer faces of the cams 148 and 149, are illustrated in FIG. 7.

Figure 8:
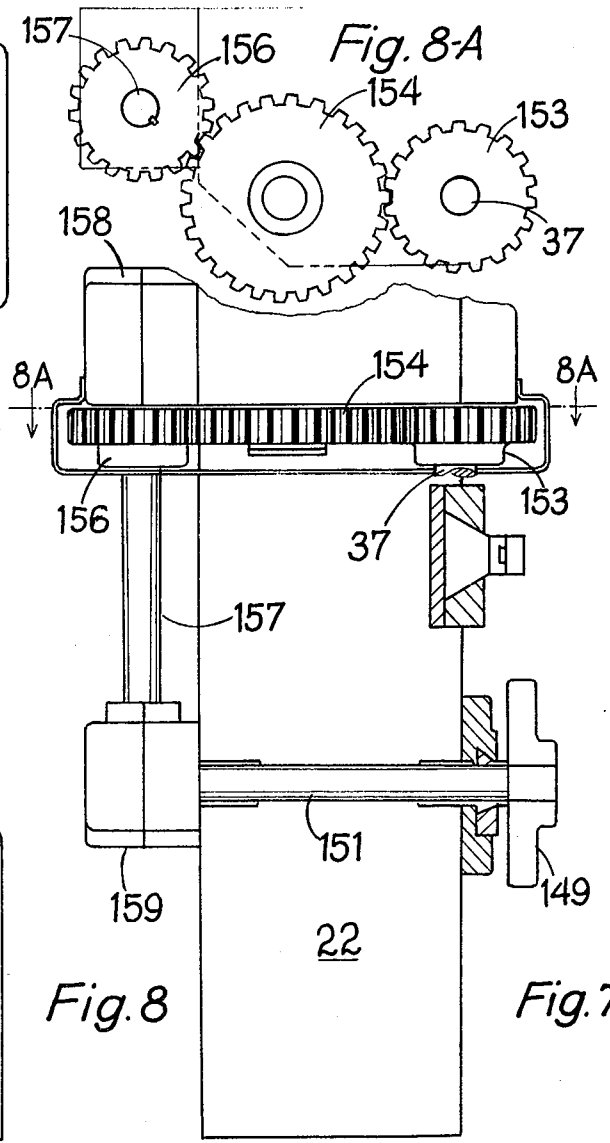
FIG. 8 is a fragmentary left end elevation view of the fourslide machine, showing the drive gear train employed for actuating the optional angle forming slides.
Figure 9:
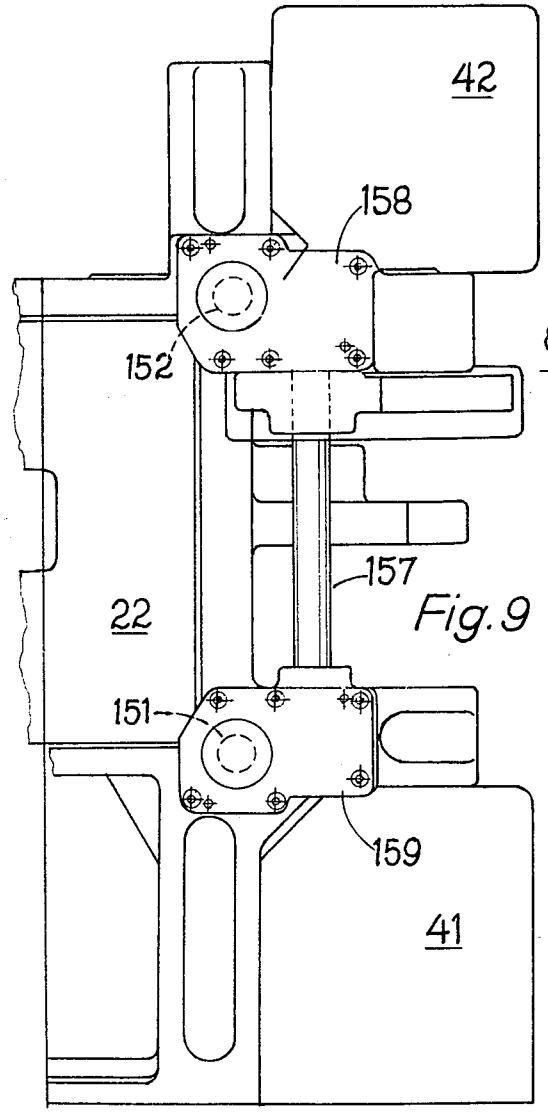
FIG. 9 is a fragmentary rear elevation view of the fourslide machine corresponding to FIG. 7 and showing the housing for the drive train components employed with the angle forming slides.

FIGS. 8 and 9 show the gear drive train actuating the angle cams 148 and 149. In the fragmentary schematic diagram of FIG. 8, cam 149 is shown keyed on the front end of a lower angle camshaft 151 extending horizontally through journal bearings in the frame 22 of the machine. A corresponding upper angle camshaft 152 similarly journaled in frame 22 is shown in the front view of FIG. 7 directly above shaft 151.

Driving torque for both shafts 151 and 152 is derived directly from left camshaft 37 on which is mounted an angle slide drive gear 153. As shown in FIGS. 8 and 8A, gear 153 engages an intermediate idler gear 154 which is itself engaged with a driven gear 156 keyed on a short vertical shaft 157 journaled in a pair of offset gear boxes, an upper gear box 158 and a lower gear box 159, bolted on the rear face of frame 22 behind the metal forming area 31, as shown in the rear view of FIG. 9. The rear ends of shafts 151 and 152 are likewise journaled in gear boxes 158 and 159. As indicated in FIG. 9, the axes of shafts 151 and 152 are parallel to each other and perpendicular to the axis of vertical shaft 157, being offset therefrom by a substantial distance. Accordingly, shaft 157 is geared to drive shafts 151 and 152 by two pairs of helical gears, respectively mounted at the upper and lower ends of shaft 157 inside gear boxes 158 and 159.

Rotation of camshaft 37 thus drives the optional angle slides 146 and 147 through gear train 153–154–156, shaft 157 and the helical gears in gear boxes 158 and 159, simultaneously rotating shafts 151 and 152 to drive the cams 148 and 149 in synchronism with all of the other cams operating the feed mechanism and the standard fourslides 136–139.

REAR-REMOVABLE KINGPOST ASSEMBLY

Figure 10:
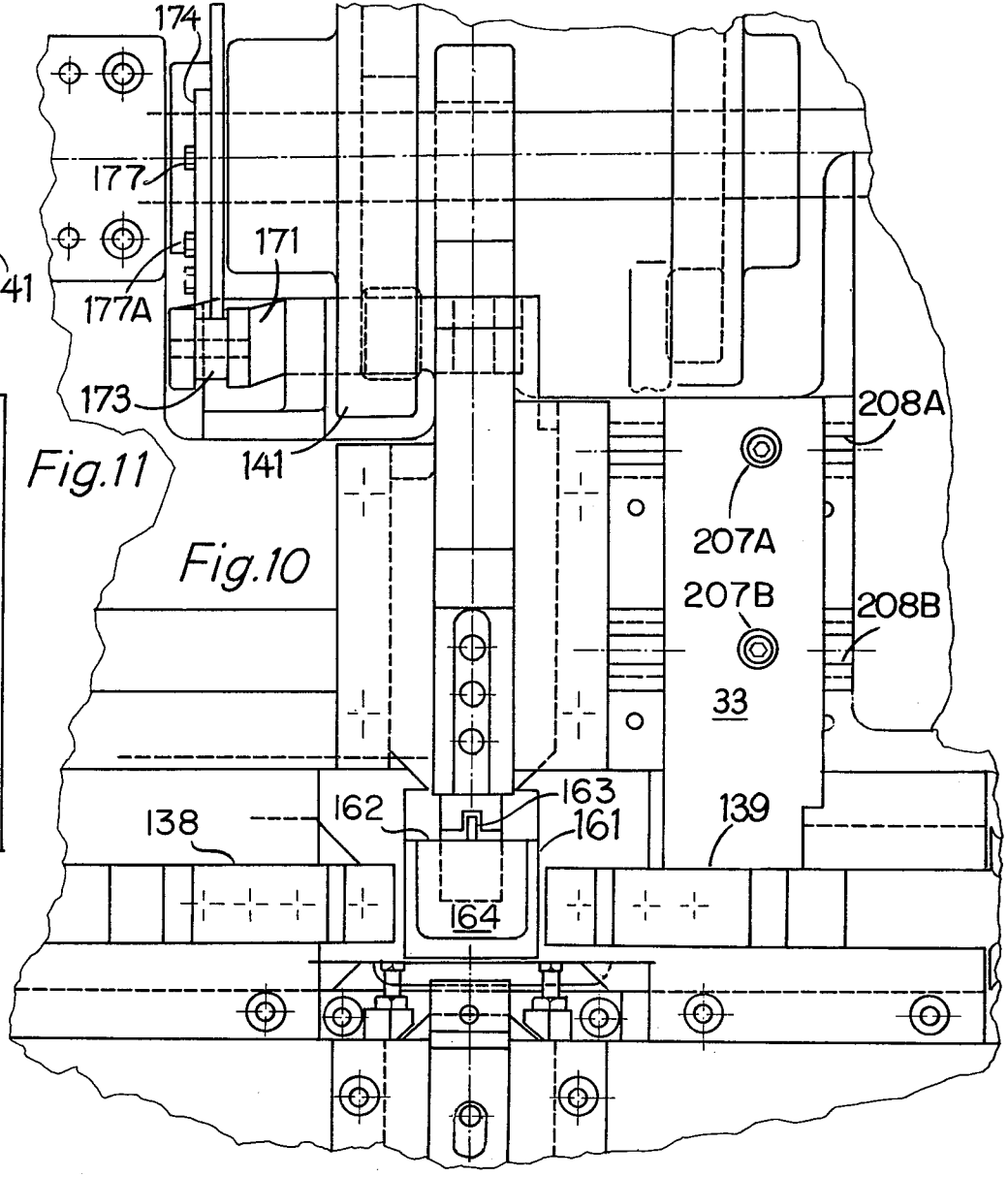
FIG. 10 is an enlarged fragmentary front elevation view of the forming area of the fourslide machine showing the kingpost and the cut-off unit.
Figure 11:
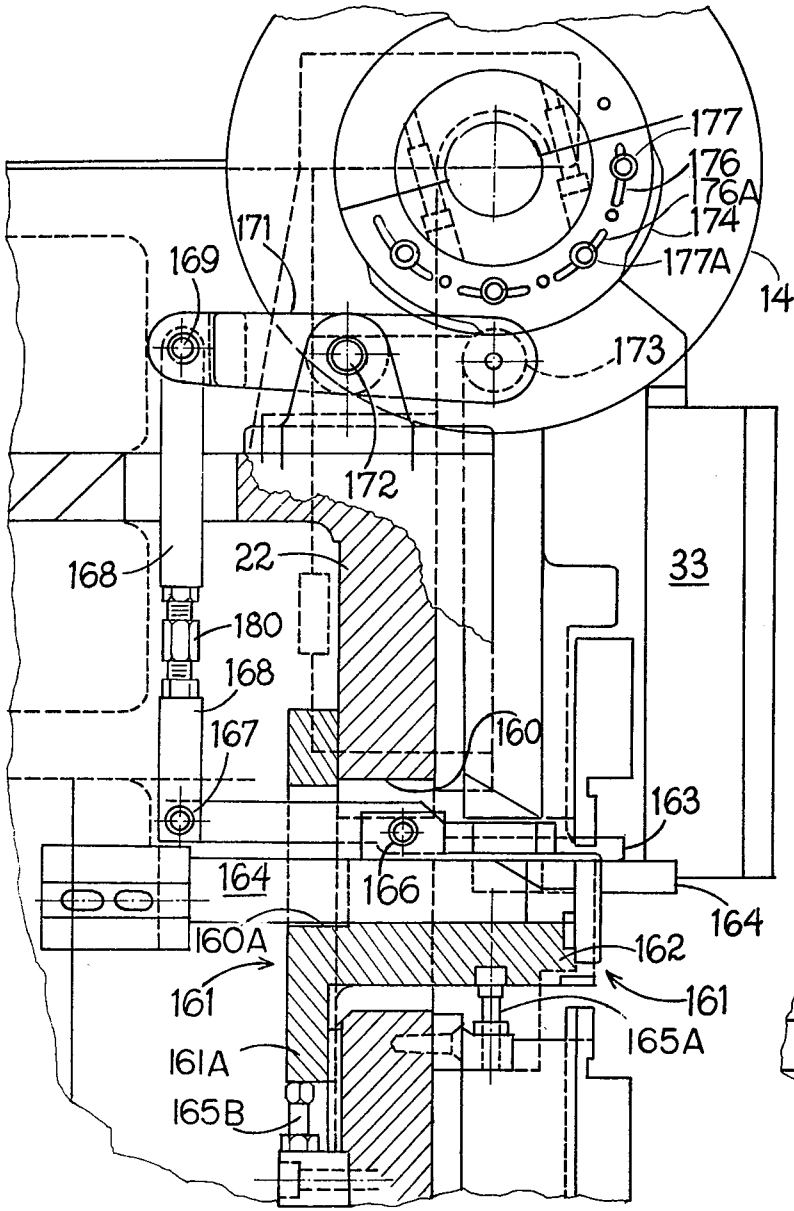
FIG. 11 is a correspondingly enlarged fragmentary cross-sectional left end elevation view of the forming area of the machine showing the cut-off unit and the removable kingpost assembly and stock-clamping linkage.

Illustrated in FIGS. 10 and 11 is the kingpost 161, the central work support mounted at the forming station for cooperation with the fourslides and the two optional angle slides. Kingpost 161 is shown in detail in the cross-sectional end elevation view of FIG. 11. Kingpost 161 supports associated parts such as a mandrel 155 cooperating with conventional stock-forming tooling mounted on the four slides 136, 137, 138 and 139 and operating in the same manner as conventional fourslide machines. Kingpost 161 incorporates a tool block platform 162 extending through a suitable aperture 160 in the frame 22 of the machine and aperture 160A formed in a rear plate portion 161A of kingpost 161, at the conjunction of the operating axes of the fourslides and the optional angle slides. This tool block platform portion 162 is grooved to receive a center form or mandrel 164 cooperating with a stock clamping or binder jaw 163, pivoted on the center form 164. Stock binder jaw 163 thus forms a lever supported on tool block platform portion 162 by a pivot 166, and the rear end of the jaw lever 163 is pivotally joined at a second pivot 167 to a substantially vertical actuating link 168, whose upper end is pivoted at 169 to a substantially horizontal offset rocker 171 centrally pivoted at pivot 172 on the frame 22. The forward end of rocker 171 carries a follower roller 173 engaging the periphery of an adjustable stock binder cam 174, also shown in the upper left hand corner of FIG. 10. As indicated in FIG. 11, a plurality of circumferential slots 176, 176A etc. and bolts 177, 177A etc. join two separate portions of cam 174, for convenient angular adjustment of the rise and fall sectors of cam 174.

CUT-OFF UNIT

Directly beside the kingpost 161 illustrated in FIG. 10 is a substantially conventional cut-off unit 33, bolted by T-bolts 207A, 207B to horizontal T-slots 208A, 208B formed in the face of frame 22 above the right slide 139. The horizontal T-slots 208A, 208B permit horizontal sliding adjustment of the cut-off unit to accommodate workpieces of many different sizes, while maintaining anchored stability of the cut-off head (not shown in the drawings) and permitting cut-off adjustment as close as one and three-eighths inches to the center line of center form 164 without requiring offsetting of the cut-off tool. The cut-off unit 33 is shown only schematically in the drawings, and operates in a conventional manner to sever each newly-formed workpice from the stock being fed toward the mandrel 164 part cut-off unit 33.

REMOVABILITY OF KINGPOST

The kingpost 161 assembled with center form 164 and the stock binder clamping jaw 163 can be bench assembled as a unit, and easily inserted and withdrawn from the rear of the machine, fitting directly through the central aperture 160 in the machine frame 22.

Adjustability of the entire assembly is enhanced by vertical anchoring slots (not shown in drawings) formed in the rear plate 161A of the kingpost 161 accommodating adjustment bolts anchoring the kingpost and associated parts to the rear side of frame 22 in any vertically adjusted position desired. Sturdy vertical support of the entire kingpost assembly is provided by adjustable front support bolts 165A under the front portion of tool block platform portion 162 of kingpost 161, and adjustable rear support bolts 165B under the slotted rear plate portion 161A of kingspost 161. Support bolts 165A and 165B are threaded into vertical threaded bores in blocks bolted to the machine frame 22, providing precise and stable underlying support for the kingpost 161, mandrel 164, stock clamping jaw 163 and associated parts. It will be noted that a central turnbuckle 180 interposed in the vertical length of link 168 allows the link to be shortened and lengthened to accommodate any vertical adjusted position of the kingpost 161 and its assembled components.

ADDITIONAL REAR SLIDE ACTUATING MOTIONS

As shown in FIG. 1, the exposed length of lower camshaft 36 supporting bottom slide actuating cam 142 directly beneath the kingpost 161 provides ample room for two additional actuating cams, flanking cam 142. These cams 181 and 182 are connected by suitable slides or pivoted follower linkages behind the left end of frame 22 in the fourslide metal forming area 31 to actuate additional tooling as required.

SLOW SPEED CAMSHAFT ACTUATION BY HANDWHEEL OR ELECTRONIC HANDWHEEL

Figure 12:
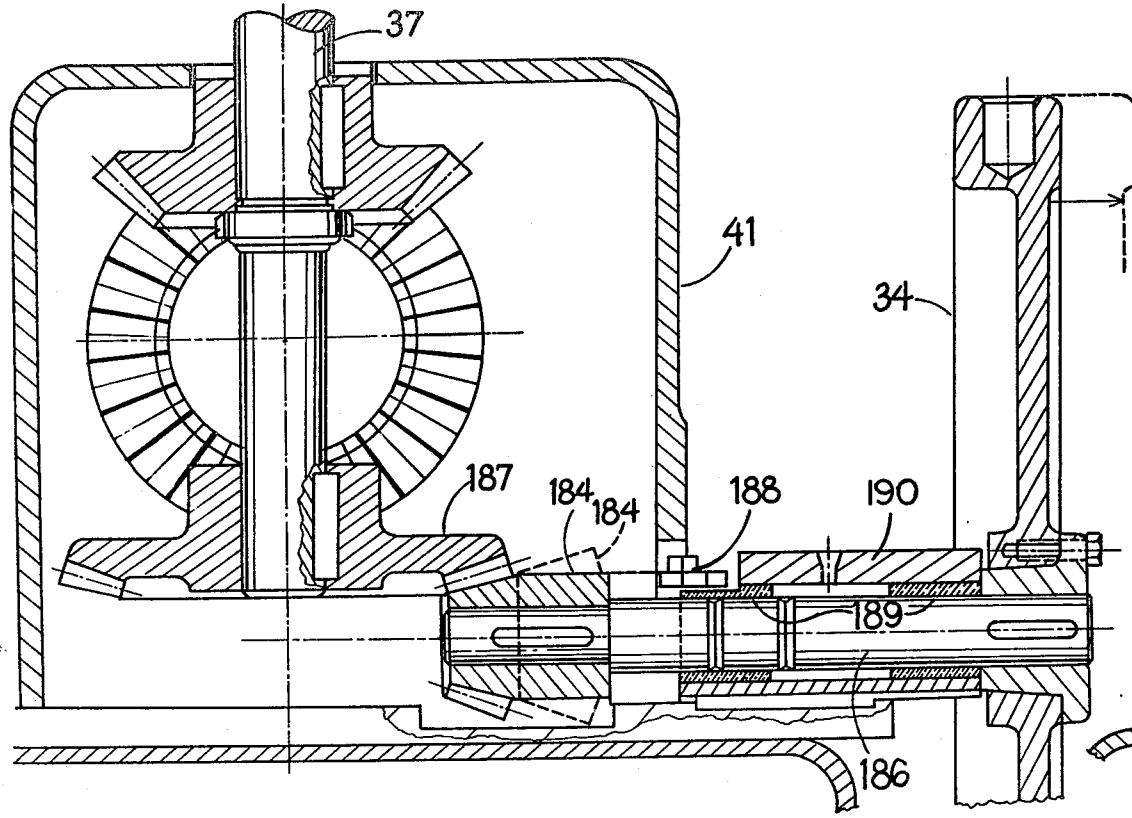
FIG. 12 is an enlarged fragmentary left end elevation view showing the handwheel mounted in the lower left bevel-gear box of the camshaft system in this fourslide machine.

For convenient setup operation of the vertical fourslide machines of the present invention, small incremental angular rotation of the geared camshafts is often helpful in setting and adjusting cams, followers and the linkages which they actuate. Two low speed incremental camshaft rotating arrangements have been employed with the machines of the present invention to achieve this objective. The manual handwheel 34 shown in FIG. 1 is seen in more detail in the cross-sectional fragmentary end elevation view of FIG. 12, showing the left lower gearbox 41 enclosing a pair of mitre or 45° bevel gears at the lower end of left camshaft 37 driving lower camshaft 36. In the fragmentary cross-sectional elevation view of FIG. 13, the same pair of mitre or 45° bevel gears joining the two camshafts 36 and 37 are also shown, with an extension of left camshaft 37 below this pair of gears engaging an "electronic handwheel" drive unit 183 shown at the bottom of FIG. 13.

As shown in FIG. 12, manual handwheel 34 is mounted on a "pull-out" shaft movable lengthwise between the engaged position shown in FIG. 12 where the smaller driving bevel gear 184 on the handwheel shaft 186 is drivingly engaged with the larger driven bevel gear 187 keyed to the lower end of the left camshaft 37, to a retracted position moved a short distance to the right in FIG. 12 where the handwheel 34 itself, shaft 186 and the driving bevel gear 184 are all retracted toward the operator as a unit, disengaging driving bevel gear 184 from driven bevel gear 187. The engaged position of driving bevel gear 184 is shown in solid lines in FIG. 12, while its disengaged retracted right-hand position is shown in dashed lines.

FIG. 12 also shows that this retracted position of bevel gear 184 draws its hub to the right into engagement with an electrical interlock 188 mounted on gear box 41 close to the handwheel shaft 186. Interlock 188 is connected to interrupt drive power to the machine whenever driving gear 184 leaves its retracted position, when it is approaching and entering into engagement with driven gear 187. Otherwise, inadvertent engagement of these gears might strip them or injure an operator whose hand might be resting on the handwheel 34.

Endwise retraction and engagement motion of handwheel shaft 186 is provided by the sleeve bushings 189 mounted inside a lubrication sleeve 190 at the lower forward portion of left lower gearbox 41.

It will thus be seen that engagement of handwheel 34 by its axial advance toward left camshaft 37 automatically disengages the power drive for the machine and permits the handwheel 34 itself to turn all four camshafts through the mitre gears in each of the four gear boxes. Feed mechanism 27 is also moved through its operating cycle by the manual actuation of handwheel 34, assuring that all parts of the entire machine are advanced in exact synchronism during all incremental setup motions. Cams, followers, slide tooling, the cutoff unit, the stock binder, a stripper, the press tooling, the feed eccentric, the feed stops and the feed check unit can thus all have their limits and their cam angles accurately adjusted for each successive stage through the entire operating cycle of the machine.

Figure 13:
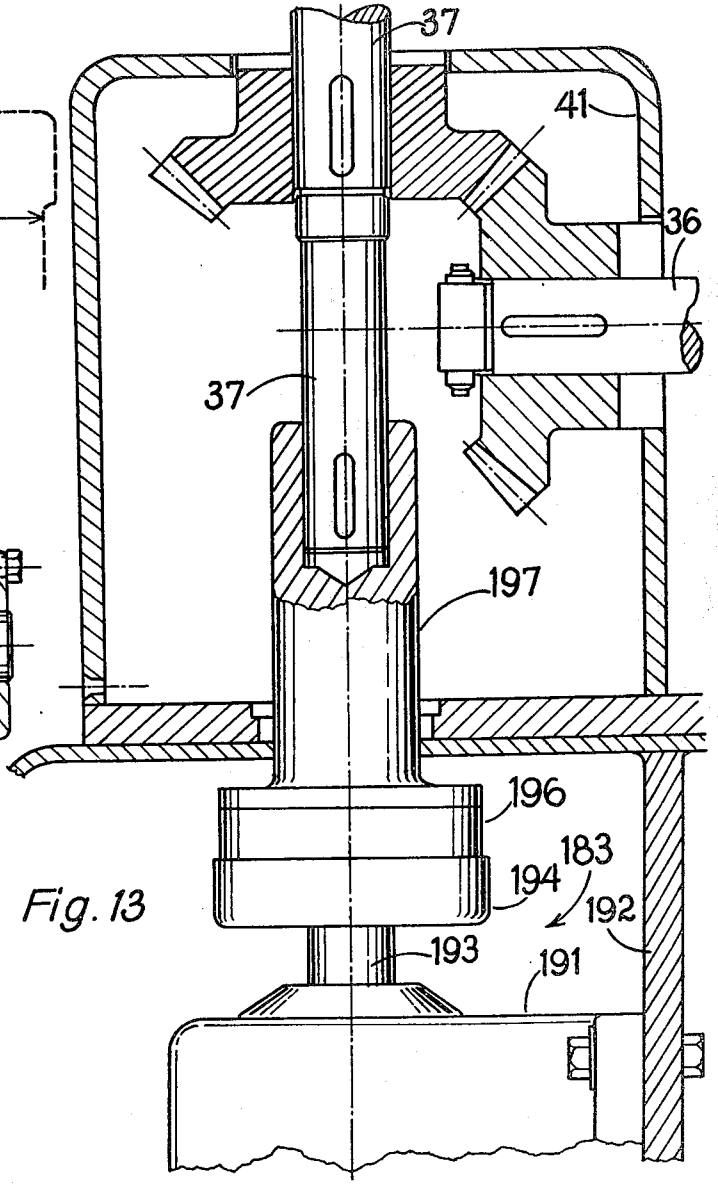
FIG. 13 is a corresponding fragmentary enlarged front cross-sectional elevation view of the lower left bevel-gear box in an alternate embodiment of this fourslide machine, incorporating and "electronic handwheel" system.

In FIG. 13, the lower bevel gear 187 is omitted and manual handwheel 34 is replaced by an "electronic handwheel" unit 183 which incorporates an "electronic handwheel" drive motor 191 anchored by mounting bolts to a housing frame partition 192 with its drive shaft 193 engaging a gearreducing unit 194. This is preferably a unit providing gear reduction of approximately 190:1, and is directly connected to a non-slip gear-type positive clutch 196 whose driven hub 197 is keyed to the lower end of left camshaft 37, as shown in the middle portion of FIG. 13. Automatic control of drive motor 191 and clutch 196 is provided by control pendant 147 where suitable control buttons provide for incremental advance and corresponding incremental reversal of the drive system, while also assuring that clutch 196 is disengaged during all normal operation of the machine through its standard drive system shown in FIG. 2.

Thus the vertical fourslide metal forming machines of the present invention achieve all of the objects enumerated, affording excellent visibility and accessibility of the adjustable cams and tooling for easy maintenance and convenient setup.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statement of the scope of the invention which, as a matter of language, might be said to fall therebetween.

We claim:

1. A fourslide metal wire and strip forming machine having stock feeding, clamping, stamping, bending and cut-off units incorporation clamping jaws and tooling acutated by rotating camshafts, comprising a frame on which the rotating camshafts are journalled and geared together for synchronized rotation, a base underlying and supporting the frame, a clutchshaft rotatably journalled in the base, in separate bearings respectively positioned near each of its ends, having one end drivingly engaged by gearing to the camshafts, and having coaxially mounted thereon a multi-belt V-belt driven sheave rotatably mounted for free rotation; an electric clutch engageable for torque-transmitting connection of the driven sheave and the clutchshaft; an electric brake; a removable end journal bearing block secured to the base and rotatably supporting the end of the clutchshaft opposite to the camshafts and providing access when removed for adjustment, disengagement, removal and replacement of the electric clutch and the electric brake; and electric drive motor mounted on the base having a motor shaft substantially parallel to the clutchshaft, with a mult-belt V-belt drive sheave positioned for belt-driving engagement with the driven sheave;

and an adjustable belt tensioning means operatively connecting said drive motor and said base for relaxing V-belt tension to release the driving belts and free the motor for movable withdrawal from the base.

2. The metal forming machine defined in claim 1, wherein the drive motor is slidably mounted on a door pivotally hinged to the base, whereby the motor after belt release may be swung out away from the machine for convenient access, readily permitting adjustment, maintenance or motor replacement.

3. The metal forming machine defined in claim 1, wherein the clutchshaft axis is vertical, with the driven sheave, the clutch, the brake and the end bearing block being successively arrayed form the middle of the clutchshaft toward its lowre end, and wherein the clutchshaft is journalled above the driven sheave in additional bearing block means, permitting successive dismounting and lowering removal of brake and clutch after removal of the end bearing block from the lower end of the clutch shaft.

4. A fourslide metal wire and strip forming machine having two alternative drive motors connected to operate stock feeding, clamping, stamping, bending and cut-off units incorporating clamping jaws and tooling, all actuated by rotating camshafts selectively driven by one or the other of the two drive motors, comprising a frame on which the rotating camshafts are journalled and geared together for synchronized rotation, a base underlying and supporting the frame, a principal drive motor clutch-engageable to drive the camshafts, a supplemental reversible, low-torque "electronic-handwheel" drive motor substantially smaller than the principal drive motor and connected by a speed reducer having a speed reduction ratio of at least 150:1 via a disengageable clutch to drive the camshaft when the principal drive motor is disengaged and supplemental drive motor control means connected for reversible actuation of the supplemental drive motor in small angular increments for convenient set up and adjustment of moving parts of the machine.

5. The fourslide metal forming machine defined in claim 4 wherein the control means is mounted on a pendant control panel suspended from an overlying arm pivotally supported by the frame for movement through a range of positions extending across the front of the fourslide machine.

* * * * *